US007736704B2

(12) United States Patent
Chandra et al.

(10) Patent No.: US 7,736,704 B2
(45) Date of Patent: Jun. 15, 2010

(54) PROCESS FOR APPLYING A PROTECTIVE LAYER

(75) Inventors: Sharad Chandra, Oberhausen (DE); Norbert Czech, Dorsten (DE)

(73) Assignee: Man Turbo AG, Oberhausen (DE)

( * ) Notice: Subject to any disclaimer, the term of this patent is extended or adjusted under 35 U.S.C. 154(b) by 1106 days.

(21) Appl. No.: 11/225,660

(22) Filed: Sep. 13, 2005

(65) Prior Publication Data

US 2006/0177582 A1 Aug. 10, 2006

(30) Foreign Application Priority Data

Sep. 15, 2004 (DE) ..... 10 2004 045 049

(51) Int. Cl.

*B05D 3/12* (2006.01)
*B05D 7/14* (2006.01)
*B05D 7/22* (2006.01)
*B05D 1/38* (2006.01)

(52) U.S. Cl. ..... 427/419.1; 427/237; 427/239; 427/252; 427/253; 427/419.2

(58) Field of Classification Search ..... 427/230, 427/237, 239, 252, 253, 355, 419.1, 419.2
See application file for complete search history.

(56) References Cited

U.S. PATENT DOCUMENTS 4,321,310 A 3/1982 Ulion et al.
4,897,315 A 1/1990 Gupta
4,916,022 A 4/1990 Solfest et al.
5,866,271 A 2/1999 Stueber et al.
6,129,991 A 10/2000 Warnes et al.
6,149,389 A 11/2000 Hennies et al.
6,273,678 B1 * 8/2001 Darolia ..... 415/200
6,340,500 B1 1/2002 Spitsberg
6,472,018 B1 10/2002 Warnes et al.
6,482,469 B1 11/2002 Spitsberg et al.
6,544,346 B1 * 4/2003 Grossklaus et al. ..... 134/29
6,572,981 B2 6/2003 Spitsberg
6,607,611 B1 8/2003 Darolia
6,706,325 B2 3/2004 Spitsberg et al.

(Continued)

FOREIGN PATENT DOCUMENTS

DE 42 26 272 C1 2/1994

(Continued)

OTHER PUBLICATIONS

Ashok K. Ray and Rolf W. Steinbrech, Crack Propagation Studies of Thermal Barrier Coatings Under Bending, "Journal of the European Ceramic Society" 19 (199) 2097-2109, pp. 2097-2109.

*Primary Examiner*—William Phillip Fletcher, III
(74) *Attorney, Agent, or Firm*—McGlew and Tuttle, P.C.

(57) ABSTRACT

To protect a base metal layer (1) against high-temperature corrosion and high-temperature erosion, an adhesive layer (3) based on MCrAlY is applied to the base metal layer (1). The adhesive layer (3) is coated with an Al diffusion layer (4) by alitizing. The diffusion layer (4) is subjected to an abrasive treatment, so that the outer built-up layer (4.2) on the diffusion layer (4) prepared by alitizing is removed by the abrasive treatment. A ceramic heat insulation layer (2) consisting of zirconium oxide, which is partially stabilized by yttrium oxide, is applied to the diffusion layer (4) thus treated.

9 Claims, 1 Drawing Sheet

U.S. PATENT DOCUMENTS

| | | | |
|---|---|---|---|
| 2003/0044624 | A1 | 3/2003 | Spitsberg et al. |
| 2003/0203221 | A1 | 10/2003 | Spitsberg |

FOREIGN PATENT DOCUMENTS

| | | | | |
|---|---|---|---|---|
| DE | 19609690 | A1 | | 10/1997 |
| EP | 0532255 | A1 | | 3/1993 |
| EP | 1 127 959 | A1 | | 8/2001 |
| EP | 1 217 089 | A2 | | 6/2002 |
| EP | 1260612 | A1 | | 11/2002 |
| EP | 1378587 | A1 | | 1/2004 |
| EP | 1 473 378 | A1 | | 11/2004 |
| EP | 1 507 018 | A1 | | 2/2005 |
| GB | 2 269 383 | | | 2/1994 |
| JP | 05078860 | | | 3/1993 |
| JP | 09157866 | | | 6/1997 |
| WO | WO 93/03201 | A1 | * | 2/1993 |
| WO | WO 96/34129 | | | 10/1996 |
| WO | WO 96/34130 | A1 | * | 10/1996 |
| WO | WO9634130 | | | 10/1996 |

* cited by examiner

PROCESS FOR APPLYING A PROTECTIVE LAYER

CROSS REFERENCE TO RELATED APPLICATIONS

This application claims the benefit of priority under 35 U.S.C. § 119 of German Application DE 10 2004 045 049.8 filed Sep. 15, 2004, the entire contents of which are incorporated herein by reference.

FIELD OF THE INVENTION

The present invention pertains to a process for applying a protective layer on a base metal so the base metal layer is resistant to high-temperature corrosion and high-temperature erosion. The process is particularly useful for modern gas turbines in which surfaces are subjected to hot gas.

BACKGROUND OF THE INVENTION

The surfaces in the hot gas area are provided nearly completely with coatings in modern gas turbines. The heat insulation layers used in such applications are used to lower the material temperature of cooled components. As a result, the service life can be prolonged, the cooling air can be reduced, or the machine can be operated at higher inlet temperatures. Heat insulation systems always comprise a metallic adhesive layer connected with the base material (base metal) by diffusion and a superjacent ceramic layer with poor thermal conductivity, which is the actual barrier against the heat flow and protects the base metal against high-temperature corrosion and high-temperature erosion.

Zirconium oxide, which is partially stabilized with about 7 wt. % of yttrium oxide (international acronym "YPSZ" from Yttria Partially Stabilized Zirconia), has proved to be a suitable ceramic material for the heat insulation layer. The heat insulation layers are classified to two essential classes according to the particular method employed to apply them. Depending on the desired layer thickness and the stress distribution, a porosity between about 10 vol. % and 25 vol. % is set in the case of the thermally sprayed layers (mostly layers sprayed with atmospheric plasma, APS). The binding to the rough-sprayed adhesive layer is brought about by mechanical clamping.

Heat insulation layers that are applied by vapor deposition carried out by physical vapor deposition processes by means of an electron beam (EB-PVD processes) have a columnar, stretching-tolerant structure if certain deposition conditions are complied with. The layer is bound chemically in the case of this process due to the formation of an Al/Zr mixed oxide on a pure aluminum oxide layer (Thermally Grown Oxide, TGO), which is formed by the adhesive layer during the application and subsequently during the operation. This process imposes special requirements on the oxide growth on the adhesive layer. In principle, both diffusion layers and support layers may be used as adhesive layers.

The following complex requirements are imposed on the adhesive layers, namely, low static and cyclic rates of oxidation, formation of the purest possible aluminum oxide layer as a TGO (in case of layers prepared according to the EB-PVD process), sufficient resistance to high-temperature corrosion, low brittle/ductile transition temperature, high creep strength, good adhesion, minimal long-term interdiffusion with the base material, and economical application of the adhesive layer with a reproducible quality.

Metallic support layers from a special alloy based on MCrAlY (M=Ni, Co) offer the best possibilities for meeting the chemical and mechanical requirements for the special requirements imposed in stationary gas turbines. The properties of the support layers can be further improved by the addition of special refractory alloying elements such as rhenium and tantalum or by alitizing. MCrAlY layers contain the intermetallic β phase NiCoAl as an aluminum reserve in an NiCoCr ("γ") matrix. However, this phase also has an embrittling effect, so that the Al content that can be reached in practice in the MCrAlY layer is less than 12 wt. %. To further increase the oxidation resistance, it is known (WO 96/34129) that the MCrAlY layers can be coated with an Al diffusion layer in order to increase the Al content of these layers. However, this process has hitherto been extensively limited to low-aluminum starting layers because of the risk of embrittlement.

SUMMARY OF THE INVENTION

The basic object of the present invention is to provide a process by means of which the oxidation resistance of simple MCrAlY layers acting as adhesive layers is improved by increasing the Al content of the MCrAlY layer without embrittlement taking place.

According to the invention, a process is provided for applying a protective layer resistant to high-temperature corrosion and high-temperature erosion to a base metal layer. An adhesive layer based on MCrAlY is applied to the base metal layer. The adhesive layer is coated with an Al diffusion layer by alitizing. A ceramic heat insulation layer consisting of zirconium oxide, which is partially stabilized by yttrium oxide, is applied to the diffusion layer. The diffusion layer is subjected to an abrasive treatment, so that the outer built-up layer of the diffusion layer produced by alitizing is removed by the abrasive treatment.

A diffusion layer with the diffusion zone proper with an Al content of about 20% and an outer built-up layer with an Al content of about 30% may be prepared by the alitizing. The outer built-up layer of the diffusion layer, which is located above the diffusion zone proper, is removed by the abrasive treatment to the extent that the Al content in the surface of the remaining diffusion layer is at least 18% and below or less than 30%.

The abrasively treated diffusion layer may be subjected to fine smoothing. The alitizing of the adhesive layer may be carried out in one process step simultaneously with an inner coating of the cooling channels of a hollow component.

The structure of the alitized MCrAlY layer advantageously comprises the inner, extensively intact γ/β mixed phase, a diffusion zone, in which the Al content increases to about 20%, and an outer layer with a β-NiAl phase, which has an Al content of about 30%. This outer layer represents the weak point of the layer system in terms of brittleness and susceptibility to cracking. It is removed according to the present invention by the abrasive treatment down to the diffusion zone, as a result of which an Al content of 18% to less than 30% is set in the surface of the remaining layer. The removal of the outer layer can be carried out by blasting with usual media, such as corundum, silicon carbide, chopped metal wires and similar materials.

Due to the increase in the Al content in the simple MCrAlY layer because of the alitizing, the oxidation resistance of this layer acting as an adhesive layer is improved. The embrittlement on the surface of the alitized layer, which is caused by the alitizing, is prevented from occurring but at least minimized by the abrasive aftertreatment.

The service life of the heat insulation layers deposited by vapor deposition especially by means of an electron beam is considerably prolonged by the higher aluminum content. In case of premature failure of the heat insulation layer, e.g., due to the impact of foreign bodies or erosion, a longer "emergency operation" is possible. On the other hand, the risk of crack initiation is minimized by the removal of the especially brittle β-NiAl phase.

The alitizing of the adhesive layer and of the inner cooling channels of the component can be carried out simultaneously, so that there will be only slight extra costs for the blasting.

The process according to the present invention can be applied to all blades and optionally other components of the turbine that are exposed to hot gases, which are coated with heat insulation layers, especially with heat insulation layers prepared according to the EB-PVD process.

An exemplary embodiment of the present invention is shown in the drawings and will be explained in greater detail below. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the process of the invention are illustrated.

DESCRIPTION OF THE PREFERRED EMBODIMENTS

Figure 1:
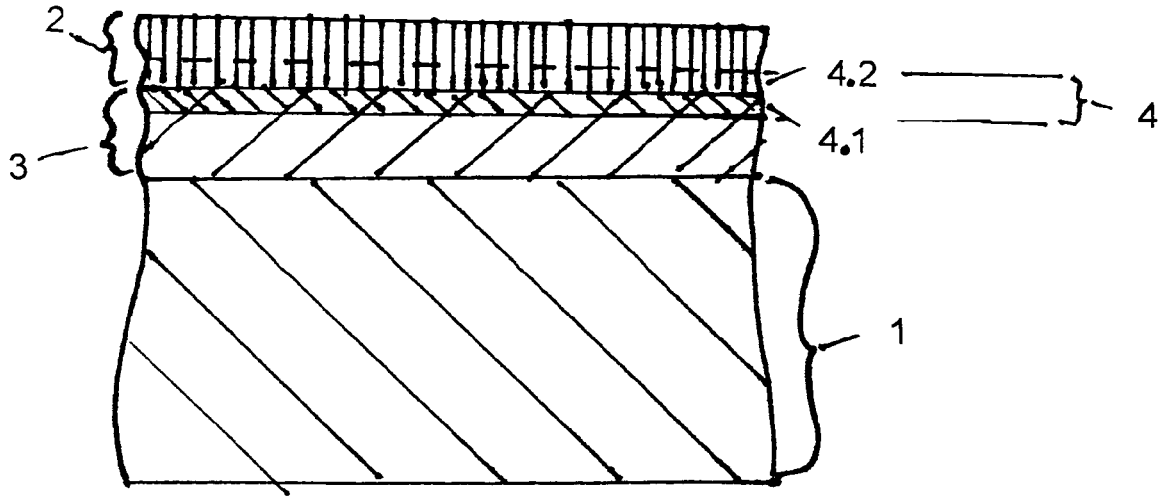
FIG. 1 is a schematic view showing a true-to-scale cross-sectional view through a base metal provided with a coating.
Figure 2:
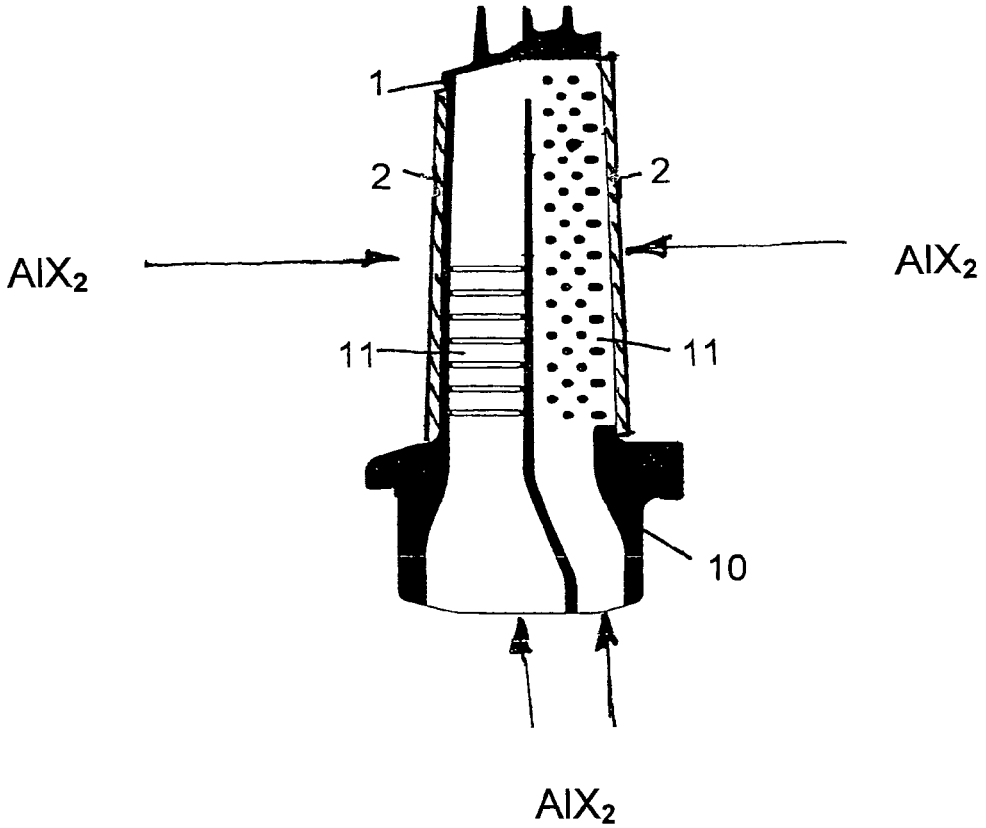
FIG. 2 is a longitudinal sectional view through a gas turbine blade.

Referring to the drawings in particular, a gas turbine blade 10 according to FIG. 2 is of a hollow design and has cooling channels 11 on the inside.

A base metal layer 1, which may be the base material for the blade 10 of the gas turbine or even for another component of a gas turbine that comes into contact with hot gas, is provided with a ceramic heat insulation layer 2 for protection against high-temperature corrosion and high-temperature erosion. The heat insulation layer 2 consists of zirconium oxide, which is partially stabilized with about 7 wt. % yttrium oxide (YPSZ from Yttria Partially Stabilized Zirconia).

To improve the adhesion of the heat insulation layer 2 on the base material of the base metal layer 1, a support layer acting as an adhesive layer 3 is applied first on the base material. The adhesive layer 3 consists of a special alloy based on MCrAlY. The letter M designates Ni or Co here. The adhesive layer may be applied according to the physical vapor deposition process using electron beams (EB-PVD process). According to a preferred process embodiment the low-pressure plasma spray process (LPPS process) is used to apply the adhesive layer.

To increase the Al content in the adhesive layer 3, the latter is coated with an Al diffusion layer 4. The coating is carried out by alitizing, i.e., by a treatment during which a reactive Al-containing gas, which is usually an Al halide ($AlX_2$), brings about the inward diffusion of Al at elevated temperature, associated with an outward diffusion of Ni.

At the same time, inner coating of the cooling channels 11 of the gas turbine blade 10 can be carried out by guiding the reactive Al-containing gas ($AlX_2$) correspondingly.

An inner diffusion zone 4.1 is formed within the diffusion layer 4 on the extensively intact adhesive layer 3 due to the alitizing, and an outer built-up layer 4.2 consisting of a brittle β-NiAl layer is formed over the diffusion layer.

The outer built-up layer 4.2 is removed by blasting with hard particles, such as corundum, silicon carbide, metal wires or other known grinding or polishing agents down to the inner diffusion zone 4.1 of the diffusion layer 4.

The abrasive treatment is carried out to the extent that the surface of the remaining diffusion layer 4 will have an Al content exceeding 18% and lower than 30%.

The blasted diffusion layer 4 is preferably subjected to fine smoothing after the abrasive treatment.

Subsequently to the above-described process steps, the heat insulation layer 2 is applied by a physical vapor deposition process by means of electron beams.

While specific embodiments of the invention have been shown and described in detail to illustrate the application of the principles of the invention, it will be understood that the invention may be embodied otherwise without departing from such principles.

What is claimed is:

1. A process for applying a protective layer resistant to high-temperature corrosion and high-temperature erosion to a base metal layer, the process comprising:

applying an adhesive layer composed of an MCrAlY alloy to the base metal layer;

coating the adhesive layer with an Al diffusion layer by alitizing;

subjecting the diffusion layer to an abrasive treatment, so that the outer built-up layer of the diffusion layer produced by alitizing is at least partially removed by the abrasive treatment; and applying a ceramic heat insulation layer, consisting essentially of zirconium oxide, which is partially stabilized by yttrium oxide, to the diffusion layer, the diffusion layer including a diffusion zone proper with an Al content of about 20% and an outer built-up layer with an Al content of about 30% prepared by the alitizing, and the outer built-up layer of the diffusion layer, which is located above the diffusion zone proper, being removed by the abrasive treatment to the extent that the Al content in the surface of the remaining diffusion layer exceeds 18% and is lower than 30%.

2. A process in accordance with claim 1, wherein the abrasively treated diffusion layer is subjected to fine smoothing.

3. A process in accordance with claim 1, wherein the base metal layer is a hollow component comprising cooling channels, said adhesive layer being applied to an outer surface of said hollow component, said adhesive layer being coated with said Al diffusion layer simultaneously in one process step with an inner coating of said cooling channels via alitizing.

4. A process for forming a component to be subjected to high temperatures during use, the process comprising:

providing a component with a base metal layer;

applying an adhesive layer composed of an MCrAlY alloy to the base metal layer;

coating the adhesive layer with an Al diffusion layer by alitizing to provide an inner diffusion zone formed within the diffusion layer on the adhesive layer and an outer built-up layer;

subjecting the diffusion layer to an abrasive treatment, so that the outer built-up layer of the diffusion layer produced by alitizing is removed by the abrasive treatment; and applying a ceramic heat insulation layer, consisting essentially of zirconium oxide, which is partially stabilized by yttrium oxide, to the diffusion layer to form a protective layer resistant to high-temperature corrosion and high-temperature erosion, wherein:

upon coating said adhesive layer with an Al diffusion layer by alitizing said inner diffusion zone has an Al content of about 20% and said outer built-up layer has an Al content of about 30%; and said outer built-up layer located above said inner diffusion zone is removed by the abrasive treatment to the extent that the Al content in the surface of the remaining diffusion layer exceeds 18% and is less than 30%.

5. A process in accordance with claim 4, wherein the abrasively treated diffusion layer is subjected to fine smoothing.

6. A process in accordance with claim 4, wherein said component is a hollow component comprising cooling channels, said adhesive layer being applied to an outer surface of said hollow component, said adhesive layer being coated with said Al diffusion layer simultaneously in one process step with an inner coating of said cooling channels via alitizing.

7. A process for providing a heat resistant gas turbine component, the process comprising the steps of:

providing a base gas turbine component with a base metal layer;

applying an adhesive layer composed of an MCrAlY alloy to the base metal layer;

coating the adhesive layer with an Al diffusion layer by alitizing;

subjecting the diffusion layer to an abrasive treatment, so that at least a portion of the diffusion layer produced by alitizing is removed by the abrasive treatment; and applying a ceramic heat insulation layer, comprising zirconium oxide, which is partially stabilized by yttrium oxide, to the diffusion layer to form a protective layer resistant to high-temperature corrosion and high-temperature erosion, wherein:

said step of coating the adhesive layer with an Al diffusion layer by alitizing provides an inner diffusion zone and an outer built-up layer;

said step of subjecting the diffusion layer to an abrasive treatment includes removing the outer built-up layer of the diffusion layer produced by alitizing by the abrasive treatment leaving said inner diffusion zone substantially intact; and upon coating said adhesive layer with an Al diffusion layer by alitizing said inner diffusion zone has an Al content of about 20% and said outer built-up layer has an Al content of about 30%.

8. A process for providing a heat resistant gas turbine component, the process comprising the steps of:

providing a base gas turbine component with a base metal layer;

applying an adhesive layer composed of an MCrAlY alloy to the base metal layer;

coating the adhesive layer with an Al diffusion layer by alitizing;

subjecting the diffusion layer to an abrasive treatment, so that at least a portion of the diffusion layer produced by alitizing is removed by the abrasive treatment; and applying a ceramic heat insulation layer, comprising zirconium oxide, which is partially stabilized by yttrium oxide, to the diffusion layer to form a protective layer resistant to high-temperature corrosion and high-temperature erosion, wherein:

said step of coating the adhesive layer with an Al diffusion layer by alitizing provides an inner diffusion zone and an outer built-up layer;

said step of subjecting the diffusion layer to an abrasive treatment includes removing the outer built-up layer of the diffusion layer produced by alitizing by the abrasive treatment leaving said inner diffusion zone substantially intact;

upon coating said adhesive layer with an Al diffusion layer by alitizing said inner diffusion zone has an Al content of about 20% and said outer built-up layer has an Al content of about 30%; and said outer built-up layer located above said inner diffusion zone is removed by the abrasive treatment to the extent that the Al content in the surface of the remaining diffusion layer is at least 18% and is less than 30%.

9. A process for providing a heat resistant gas turbine component, the process comprising the steps of:

providing a base gas turbine component with a base metal layer;

applying an adhesive layer composed of an MCrAlY alloy to the base metal layer;

coating the adhesive layer with an Al diffusion layer by alitizing;

subjecting the diffusion layer to an abrasive treatment, so that at least a portion of the diffusion layer produced by alitizing is removed by the abrasive treatment; and applying a ceramic heat insulation layer, comprising zirconium oxide, which is partially stabilized by yttrium oxide, to the diffusion layer to form a protective layer resistant to high-temperature corrosion and high-temperature erosion, wherein:

said step of coating the adhesive layer with an Al diffusion layer by alitizing provides an inner diffusion zone and an outer built-up layer;

said step of subjecting the diffusion layer to an abrasive treatment includes removing the outer built-up layer of the diffusion layer produced by alitizing by the abrasive treatment leaving said inner diffusion zone substantially intact;

upon coating said adhesive layer with an Al diffusion layer by alitizing said inner diffusion zone has an Al content of about 20% and said outer built-up layer has an Al content of about 30%;

said outer built-up layer located above said inner diffusion zone is removed by the abrasive treatment to the extent that the Al content in the surface of the remaining diffusion layer is at least 18% and is less than 30%; and the abrasively treated diffusion layer is subjected to fine smoothing. ,

* * * * *